United States Patent [19]

Hawker

[11] Patent Number: 4,487,331

[45] Date of Patent: Dec. 11, 1984

[54] WASTE RECEPTACLE

[76] Inventor: Clifford G. Hawker, 62 Union St., Ryde, Isle of Wight, England

[21] Appl. No.: 497,635

[22] Filed: May 24, 1983

[30] Foreign Application Priority Data

May 25, 1982 [GB] United Kingdom ..... 8215271

[51] Int. Cl.[3] ..... B65D 25/16; B65D 41/18

[52] U.S. Cl. ..... 220/405; 220/1 T; 220/404; 220/408

[58] Field of Search ..... 220/408, 410, 404, 405, 220/1 H, 1 T, 1 C

[56] References Cited

U.S. PATENT DOCUMENTS

| | | | |
|---|---|---|---|
| 3,082,901 | 3/1963 | Nakagawa | 220/410 |
| 3,184,100 | 5/1965 | Thomas | 220/404 |
| 3,321,103 | 5/1967 | Phillips | 220/404 |
| 3,753,441 | 8/1973 | Bennett | 131/235 |
| 3,964,630 | 6/1976 | Getz | 220/404 |
| 4,298,134 | 11/1981 | Lewis, Jr. | 220/404 X |
| 4,444,355 | 4/1984 | Cary | 220/1 T X |

FOREIGN PATENT DOCUMENTS 320843 10/1929 United Kingdom .

*Primary Examiner*—Steven M. Pollard

*Attorney, Agent, or Firm*—Schwartz, Jeffery, Schwaab, Mack, Blumenthal & Koch

[57] ABSTRACT

A waste receptacle comprising a two-part outer housing and a disposable two-part inner waste container each having a bottom part and an apertured top part interconnectible around their perimeters, the said perimeters of the inner container parts being arranged to be received between the perimeters of the outer housing parts and sealingly interconnected by the action of interconnecting the outer housing parts.

11 Claims, 5 Drawing Figures

WASTE RECEPTACLE

Figure 1:
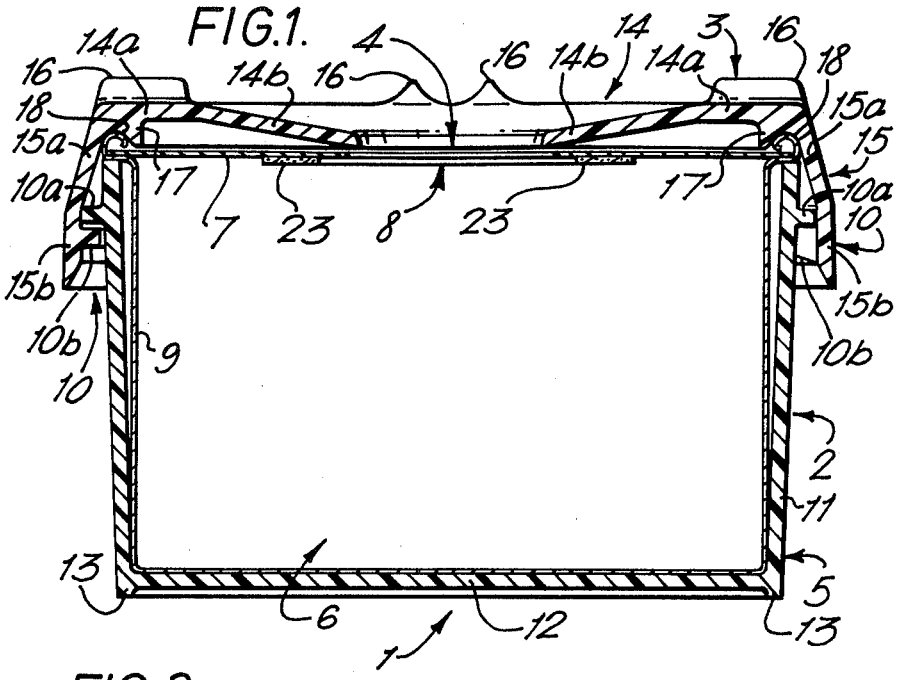

This invention relates to a waste receptacle with an inner disposable waste container.

The disposal of waste, and in particular the use of waste receptacles, presents substantial problems in terms of hygiene and cost. Generally waste receptacles, such as for example dustbins, waste paper baskets, and the like, are temporary depositories for waste during the time between production of the waste and its ultimate disposal. Such waste receptacles can constitute a health hazard if waste deposited in them is not properly and timely disposed of. To avoid undesirable retention of waste in such receptacles it is common practice to provide a disposable inner waste container, for example a plastic liner, which is supported by the waste receptacle to receive waste and is disposed of with the waste. Such inner waste containers provide a marked improvement in the hygienic disposal of waste at only a small extra cost. However, there are still problems associated with the disposal of some forms of waste, particularly those forms which include dust and other matter which is readily made airborne. In general waste receptacles, and inner containers therefor, have wide top openings to allow waste to be easily deposited in them, and as a result, dust etc. can escape into the atmosphere, particularly when the inner waste container is being disposed of.

Waste receptacles are known, for example in the form of smokers' ashtrays, which are closed at their top by a removable lid with a relatively small central aperture, with the object of reducing the escape of waste material into the atmosphere. It is however a problem to provide a cheap disposable inner waste container in a similar form, i.e. with a restricted top opening, and in the absence of such an inner container waste material tends to escape when the lid is removed from a receptacle to empty it.

According to the present invention there is provided a waste receptacle comprising a two-part outer housing and a disposable two-part inner waste container each having a bottom part and an apertured top part interconnectible around their perimeters, the said perimeters of the inner container parts being arranged to be received between the perimeters of the outer housing parts and sealingly interconnected by the action of interconnecting the outer housing parts.

The aperture in the top part of the inner container may readily be made of a restricted nature, and the invention thus solves the problem of providing a cheap disposable inner waste container with a restricted top opening, by providing the inner container in two parts which are automatically sealed together upon assembly with the outer housing, and which remain sealed together when the inner container is removed for disposal. The aperture in the top part of the outer container is preferably of substantially the same dimensions as the restricted aperture in the inner container, but it could be made larger if desired.

Preferably the bottom part of the inner waste container is provided at its said perimeter with an upwardly projecting cylindrical termination which can be folded inwardly on to the adjoining perimeter of the top part of the container to seal the two parts together. The said cylindrical termination preferably extends substantially vertically from the perimeter of an outwardly extending flange of the bottom part of the container, the perimeter of the top part of the container resting on such flange in use. The perimeter of the top part of the outer housing may then be arranged to fold the said cylindrical termination inwardly upon interconnection of the outer housing parts, for example by providing therein an annular recess of arcuate cross-section so arranged that, when the two parts of the outer housing are interconnected, the said cylindrical termination engages with the annular recess and is folded or rolled on to the top part of the inner waste container.

In one embodiment of the invention the top part of the inner waste container is generally planar, and the said aperture is centrally located therein and is slightly larger than the aperture in the top part of the outer housing. In another embodiment the top part of the inner waste container has its said aperture defined by a raised generally frusto-conical portion thereof and the aperture in the top part of the outer housing is defined in a generally cylindrical depending portion thereof which extends downwardly through the aperture in the waste container to ensure that waste passes directly into the latter container and also to distance waste deposited in the inner container from the outside environment so as to reduce the possibility of dust and odour escaping. Further, the said frustoconical portion can be crushed or pinched prior to disposal, to seal the waste in the inner container.

To further reduce the escape of unwanted odour from the inner container, a deodorizing member is preferably provided on the underside of the top part of the inner waste container, adjacent the aperture therein. Preferably the deodorizing pad is annular and surrounds the said aperture.

The two parts of the outer housing may interconnect in any desired manner, but preferably they are interconnected via a coarse screw thread.

Figure 2A:
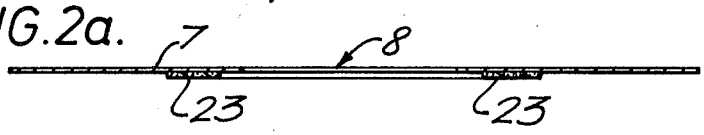
Figure 2B:
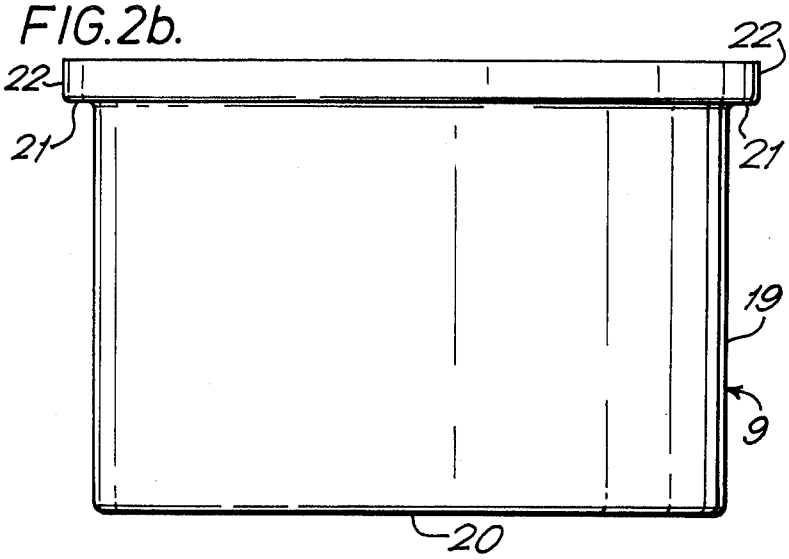
Figure 3:
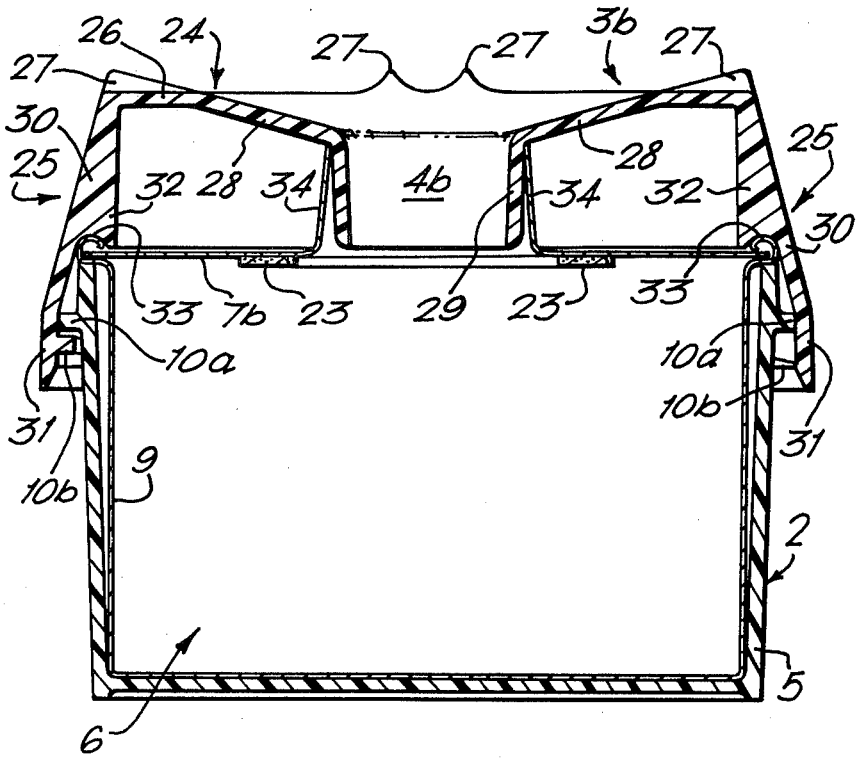
Figure 4:
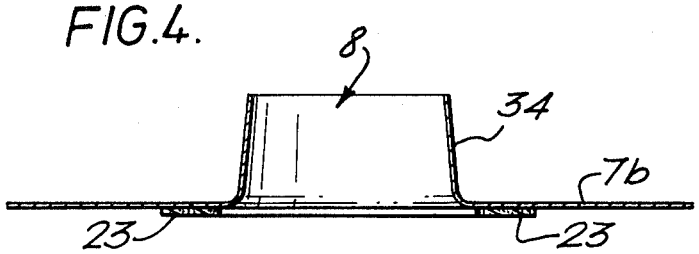

Two embodiments of the invention will now be described by way of example and with reference to the accompanying drawings, wherein:

FIG. 1 is a cross-sectional view of a waste receptacle according to a first embodiment of the invention;

FIG. 2*a* is a cross-sectional view of a top part of an inner waste container of the FIG. 1 embodiment;

FIG. 2*b* is a side elevation of a bottom part of the inner container;

FIG. 3 is a cross-sectional view of a waste receptacle according to a second embodiment of the invention; and FIG. 4 is a cross-sectional view of the top part of the inner waste container of the FIG. 3 embodiment.

Referring first to FIGS. 1 and 2 of the drawings, a receptacle 1 in the form of a smokers' ashtray of generally circular shape in plan comprises an outer housing 2 having a top part 3 with a restricted central aperature 4 and a generally cup-shaped bottom part 5, and an inner waste container 6 having a top part 7 with a restricted central aperture 8 and a generally cup-shaped bottom part 9. The two parts 3, 5 of the outer housing 2 interlockingly engage by means of a large gauge screw thread 10 and the two parts 7, 9 of the inner container 6 are adapted, as hereinafter described in detail, to be sealed together at their edge regions. The outer housing 2 is adapted, again as described in more detail hereinafter, so that in use, when the two parts 3, 5 thereof are screwed together, the two parts 7, 9 of an unsealed inner container placed in the bottom part 5 of the outer housing are thereby sealed together.

Referring to FIG. 1, the bottom part 5 of the outer housing 2 has a generally cylindrical side wall 11 and a base 12. The wall 11 decreases in diameter slightly from top to bottom and the base 12 is raised above the bottom end of the side wall so that a bottom rim 13 is formed to give stability to the container. Towards the top of the wall 11 a screw thread 10*a* is provided for mating engagement with a screw thread 10*b* provided on the top part 3 of the housing. The top part 3 is of generally of inverted cup-shape, being provided with a roof 14 from the periphery of which depends a generally cylindrical side wall 15. The roof 14 has a generally disc-shaped planar outer portion 14*a* and a downwardly sloping inner portion 14*b* in which is provided the central aperture 4. Spaced apart round outer portion 14*a* of the roof 14 are pairs of radially extending ridges 16 suitable for supporting a cigarette therebetween. The generally cylindrical side wall 15 has a frusto-conical portion 15*a* which depends from the periphery of outer portion 14*a* of the roof 14, and a cylindrical portion 15*b* which depends from the frusto-conical portion 15*a* and is provided with a screw thread 10*b*. In the region of the junction of outer portion 14*a* of the roof 14 and the frusto-conical portion 15*a* of the side wall 15, there is provided a downwardly extending annular rib 17 which is shaped to provide an annular recess 18 of arcuate cross-section.

Referring now in particular to FIG. 2, the bottom part 9 of the inner waste container 6 is generally cup-shaped having a main cylindrical wall 19 and a flat base 20. At the top of the wall 19 the edge region of the container part 9 is formed with an annular horizontal flange 21 from the periphery of which projects a vertical cylindrical terminal portion 22 which in use, is folded on to the edge region of the top part 7 to seal the two parts together. In this embodiment of the invention the top part 7 of the inner container 6 is generally in the form of disc with the aperture 8 centrally located (FIG. 2*a*). On the lower side of the top part 7 an annular deodorizing pad 23 is provided, surrounding the aperture 8.

The two parts of the outer housing may be made of any plastics suitable to provide the rigid structure required, though it is preferred that the upper portion is of a thermosetting plastic and the lower portion is of thermoplastics, e.g. ABS. The two parts of the inner container may be made of any suitable semi-rigid material which maintains the form of the inner container, while the bottom part must be suitable for allowing the vertical cylindrical portion 22 to be folded on to the surface of the top part 7. A suitable material for both parts of the inner container is aluminium foil.

In use, the top and bottom parts 7, 9 of an unsealed inner container 6 (FIG. 2 are placed in the bottom part 5 of the outer housing 2, with the top part 7 of the inner container resting on the horizontal flange 21 of its bottom part 9. The top part 3 of the outer housing is then screwed on to the bottom part 5 and, as this is done, the annular arcuate recess 18 of the top part 3 engages with the vertical cylindrical portion 22 of the bottom inner container part 9. The arcuate recess 18 will fold or roll over the portion 22 so that it engages the upper surface of the top part 7 of the inner container, thus automatically sealing the two parts of the inner container together. When the two parts 3, 5 of the outer housing 2 are fully interconnected (FIG. 1) the two parts 7, 9 of the inner container 6 will be sealed together to provide an inner waste container with a restricted aperture 4 to reduce the escape of waste to the atmosphere, while the inner container may be simply and hygienically disposed of since the top and bottom parts 7, 9 are sealed together. If desired the sealed inner container 6 may be crushed for disposal and if this is done the amount of debris which can escape is limited because of the restricted opening 4.

Referring now to FIGS. 3 and 4, in the second embodiment of the invention the bottom part 9 of the inner container 6 and the bottom part 5 of the outer housing 2 are the same as in the first embodiment, while the top part 7*b* of the inner container and the top part 3*b* of the outer housing are as now to be described.

Referring to FIG. 3, the top part 3*b* of the housing 2 is, as in the first embodiment, of a generally inverted cup-shape, being provided with a top wall 24 and a generally cylindrical side wall 25 depending from the edge of the top wall 24. As in the first embodiment the top wall 24 has a generally disc-shaped planar portion 26 with pairs of radially extending ridges 27, and a downwardly sloping inner portion 28. An aperture 4*b* is defined in the top part 3*b* by an opened ended cylindrical portion 29 of the top wall 24, which depends from the sloping inner portion 28 and is centrally located therein. The generally cylindrical side wall 25 has a frusto-conical portion 30 which is of considerably greater height than the frusto-conical portion 15*a* of the side wall 15 of the first embodiment in order to accomodate the height of the cylindrical portion 29 of the top wall 24. A cylindrical portion 31 depends from the frustoconical portion 30, and the cylindrical portion 31 is provided with a screw thread 10*b* as in the first embodiment. An annular projection 32 in the frustoconical side wall portion 30 is formed to provide an annular recess 33 of arcuate cross-section which is of the same form as the annular recess 18 of the first embodiment.

Referring to FIG. 4, the top part 7*b* of the inner container 6 is the same as that of the first embodiment except that it is provided with a central raised frusto-conical portion 34 which is opened ended to define the aperture 8 and has an internal diameter slightly greater than the external diameter of the depending cylindrical portion 29 of the top part of the outer housing.

In use, the two parts 7*b*, 9 of the inner container are sealed together by virtue of the arcuate recess 33 folding the vertical cylindrical portion 22 of the edge region of the bottom part 9 of the inner container on to the edge region of the top part 7*b*, when the two parts 3*b*, 5 of the outer housing are screwed together. At the same time the cylindrical depending top wall portion 29 will enter into the opened ended frusto-conical portion 34 of the top part 7*b* of the inner container.

The provision of the depending cylindrical portion 29 of the outer housing and the raised frusto-conical portion of the inner container ensures that waste deposited in the receptacle will enter the inner container and such waste will be distanced from the outside environment. Further, prior to the inner container 6 being disposed of, the frusto-conical portion 34 may be crushed or pinched to seal the waste therein.

Many variations are of course possible within the scope of the appended claims. For example the receptacle can be other than circular in plan, for example square or polygonal. It is not essential for the bottom part of the outer housing to take the form of a container only open at its top; its only function is to support the disposable inner container and it could therefore simply comprise a framework of open configuration.

I claim:

1. A waste receptacle comprising a two-part outer housing and a disposable two-part inner waste container each having a bottom part and an apertured top part interconnectible around their perimeters, the said perimeters of the inner container parts being arranged to be received between the perimeters of the outer housing parts and sealingly interconnected by the action of interconnecting the outer housing parts.

2. A waste receptacle as claimed in claim 1, wherein the bottom part of the inner waste container is provided at its said perimeter with an upwardly projecting cylindrical termination which can be folded inwardly on to the adjoining perimeter of the top part of the container to seal the two parts together.

3. A waste receptacle as claimed in claim 2, wherein the said cylindrical termination extends substantially vertically from the perimeter of an outwardly extending flange of the bottom part of the container, the perimeter of the top part of the container resting on such flange in use, the perimeter of the top part of the outer housing being arranged to fold the said cylindrical termination inwardly upon interconnection of the outer housing parts.

4. A waste receptacle as claimed in claim 3, wherein the perimeter of the top part of the outer housing is formed with an annular recess of arcuate cross-section so arranged that, when the two parts of the outer housing are interconnected, the said cylindrical termination engages with the annular recess and is folded or rolled on to the top part of the inner waste container.

5. A waste receptacle as claimed in claim 1, wherein the top part of the inner waste container is generally planar, and the said aperture is centrally located therein and is slightly larger than the aperture in the top part of the outer housing.

6. A waste receptacle as claimed in claim 1, wherein the top part of the inner waste container has its said aperture defined by a raised generally frusto-conical portion thereof and the aperture in the top part of the outer housing is defined in a generally cylindrical depending portion thereof which extends downwardly through the aperture in the waste container.

7. A waste receptacle as claimed in claim 1, wherein a deodorizing member is provided on the underside of the top part of the inner waste container, adjacent the aperture therein.

8. A waste receptable as claimed in claim 7, wherein the said deodorizing member is annular and surrounds the said aperture.

9. A waste receptacle as claimed in claim 1, wherein the two parts of the outer housing are interconnectible via a coarse screw thread.

10. A waste receptacle as claimed in claim 1, wherein the said inner waste container is made of crushable metal foil.

11. A waste receptacle as claimed in any one of the preceding claims, which is a smoker's ashtray.

* * * * *